US007097710B2

(12) United States Patent
Schneider

(10) Patent No.: US 7,097,710 B2
(45) Date of Patent: Aug. 29, 2006

(54) EXTRUSION APPLICATOR HAVING ROTATIONAL OPERABILITY

(75) Inventor: Uwe Schneider, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 161 days.

(21) Appl. No.: 10/834,503

(22) Filed: Apr. 29, 2004

(65) Prior Publication Data

US 2005/0241574 A1 Nov. 3, 2005

(51) Int. Cl.
*B05C 5/00* (2006.01)

(52) U.S. Cl. ..... 118/325; 118/313

(58) Field of Classification Search ..... 118/325, 118/419, 313, 669, 315, 411; 156/578; 425/382.3, 425/38, 2.3, 381, 72.1, 72.2, 66; 222/367, 222/368; 427/285, 286, 288, 208.6
See application file for complete search history.

(56) References Cited

U.S. PATENT DOCUMENTS

| | | | |
|---|---|---|---|
| 5,145,689 A | 9/1992 | Allen et al. | |
| 6,464,785 B1 | 10/2002 | Puffe | |
| 6,921,031 B1 * | 7/2005 | Puffe | 239/436 |
| 2003/0230647 A1 | 12/2003 | Wolfgang | |

FOREIGN PATENT DOCUMENTS

| | | |
|---|---|---|
| DE | 2 409 544 A1 | 9/1974 |
| DE | 197 57 238 * | 7/1999 |
| DE | 103 06 884 B3 | 6/2004 |
| EP | 0 367 985 A2 | 5/1990 |
| EP | 0 474 155 A2 | 3/1992 |
| JP | 62 193670 A | 8/1987 |

* cited by examiner

*Primary Examiner*—Brenda A. Lamb
(74) *Attorney, Agent, or Firm*—Jack Oney; Adam J. Forman; Ken Patel

(57) ABSTRACT

An applicator for application of a substance onto a material. The applicator having a housing, valve and slot. The housing having at least one housing inlet for the introduction of the substance into the housing and at least one housing channel for the distribution of the substance from the housing inlet. The valve having at least one inlet groove for the further distribution of the substance, wherein the valve is rotated to provide profiled product application functionality; and at least one inlet bore for the further distribution of the substance; and at least one valve reservoir to provide manifold functionality of the substance; and at least one outlet bore for the further distribution of the substance; and at least one inlet groove for the extrusion of the substance onto the material. The slot and the outlet groove together form an extrusion pattern of the hot-melt.

20 Claims, 11 Drawing Sheets

EXTRUSION APPLICATOR HAVING ROTATIONAL OPERABILITY

FIELD OF THE INVENTION

The present invention relates to an applicator for application of a substance onto a material; for example, the applicator may apply a hot-melt substance onto a web of material, transfer drum or belt.

BACKGROUND OF THE INVENTION

Applicators for application of a substance onto a material are well known in the art. For instance, U.S. Pat. No. 5,145,689 discloses an applicator applying adhesive from slotted nozzles in which air is directed toward the medium that leads to swirling of the emerging adhesive threads. This prevents adhesive threads from tearing off and also prevents the formation of drops which could lead to a non-uniform application of adhesive. However, due to the needed supply of air, the applicator becomes complicated and expensive. Such an applicator finds frequent application where widths of material have to be laminated onto a substrate. To minimize the specific consumption of liquid medium and, at the same time, to ensure as uniform a distribution of the medium as possible, the medium is applied intermittently to achieve a grid-like application pattern. In order to enable, at the same time, a high transport speed of the width of material, the medium has to be applied in the direction of movement of the width of material at a high frequency. The grid points extend transversely to the direction of movement of the width of material and are arranged as closely as possible to one another.

In another example, EP 0 474155 A2 and EP 0 367985 A2 illustrate applicators where hole type nozzles are controlled by a pneumatically operated nozzle needle. However, the medium cannot be applied economically to the width of material when it moves at a high speed due to limited maximum cycle frequency of the nozzle units. This limitation is the result of the mass inertia of the nozzle needles and of the control elements.

In yet another example, U.S. Pat. No. 6,464,785 discloses an applicator which has a cylinder control slide that is rotatably operable to provide intermittent or continuous strands of a substance onto a web. However, this design is limited in its ability to quickly shutter the flow of said substance. Furthermore, this design is unable to provide non-linear, strands.

What is needed is an applicator for application of a substance onto a material, wherein the applicator is able to quickly shutter the flow of said substance and is able to provide custom (e.g., non-linear) strand patterns.

SUMMARY OF THE INVENTION

An applicator for application of a substance onto a material. The applicator having a housing, valve and slot. The housing having at least one housing inlet for the introduction of the substance into the housing and at least one housing channel for the distribution of the substance from the housing inlet. The housing channel being in fluid communication with the housing inlet. The valve having at least one inlet groove for the further distribution of the substance, the inlet groove being in fluid communication with the housing channel, wherein the valve is rotated to provide profiled product application functionality; and at least one inlet bore for the further distribution of the substance, the inlet bore being in fluid communication with the inlet groove; and at least one valve reservoir to provide manifold functionality of the substance, the valve reservoir being in fluid communication with the inlet groove; and at least one outlet bore for the further distribution of the substance, the outlet bore being in fluid communication with the valve reservoir; and at least one inlet groove for the extrusion of the substance onto the material, the inlet groove being in fluid communication with the outlet bore. The slot being located on an extrusion-side surface of the housing. The slot and the outlet groove together form an extrusion pattern of the hot-melt.

The applicator also has a journal connected to the valve which rotate together to provide profiled product application functionality.

The applicator may have at least two housing channels which are symmetrically opposed such that a hot-melt supply force exerted on the valve is reduced.

The applicator may extrude hot-melt onto a continuous web, drum or belt.

The valve may further rotate to provide shuttering functionality, wherein the inlet groove is not in fluid communication with the housing channel when the valve is in a closed position, wherein the inlet groove is in fluid communication with the housing channel when the valve is in an open position.

The applicator may extrude a continuous strand of hot-melt. The strand of hot-melt may be non-linear.

The outlet grooves may deliver multiple strands having substantially the same individual dimensions and substantially the same distance between each strand despite changes in rotational position.

The outlet grooves may deliver multiple strands having substantially the same individual dimensions but varying distances between each strand during changes in rotational position.

The outlet grooves may deliver multiple strands having varying individual dimensions and varying distances between each strand during changes in rotational position.

The outlet grooves may deliver multiple strands having substantially the same individual dimensions but varying distances between each strand and different number of strands per group during changes in rotational position.

The outlet grooves may be substantially similar in overall shape but have different orientations such that they are not parallel to each other.

The outlet grooves may be substantially parallel to each other but not be longitudinally parallel to the valve.

The slot may have a varying height such that the applied hot-melt has a varying basis weight.

BRIEF DESCRIPTION OF THE DRAWINGS

While the specification concludes with claims pointing out and distinctly claiming the present invention, it is believed the same will be better understood by the following drawings taken in conjunction with the accompanying specification wherein like components are given the same reference number.

DETAILED DESCRIPTION OF THE INVENTION

As used herein, the following terms have the following meanings:

The term "disposable" is used herein to describe absorbent articles that generally are not intended to be laundered or otherwise restored or reused as an absorbent article (i.e., they are intended to be discarded after a single use and, preferably, to be recycled, composted or otherwise disposed of in an environmentally compatible manner).

The term "disposed" is used to mean that an element(s) is formed (joined and positioned) in a particular place or position as a unitary structure with other elements or as a separate element joined to another element.

The term "joined" encompasses configurations whereby an element is directly secured to another element by affixing the element directly to the other element, and configurations whereby an element is indirectly secured to another element by affixing the element to intermediate member(s) which in turn are affixed to the other element.

The term "unitary" absorbent article refers to absorbent articles which are formed of separate parts united together to form a coordinated entity so that they do not require separate manipulative parts like a separate holder and liner.

The term "diaper" refers to an absorbent article generally worn by infants and incontinent persons about the lower torso.

The term "longitudinal" refers to a direction running parallel to the maximum linear dimension of the article and includes directions within ±45° of the longitudinal direction. The "lateral" or "transverse" direction is orthogonal to the longitudinal direction. The "Z-direction" is orthogonal to both the longitudinal and transverse directions. The "x-y plane" refers to the plane congruent with the longitudinal and transverse directions.

The term "shuttering functionality" means to open and close, whether completely or partially.

The term "manifold functionality" means to supply a substance from a source location to a target location, wherein the target location has more channels/bores than the source location (e.g., from valve channel to outlet bores).

The term "profiled product application functionality" means to apply a substance onto a material in a continuous, non-linear pattern.

Figure 1:
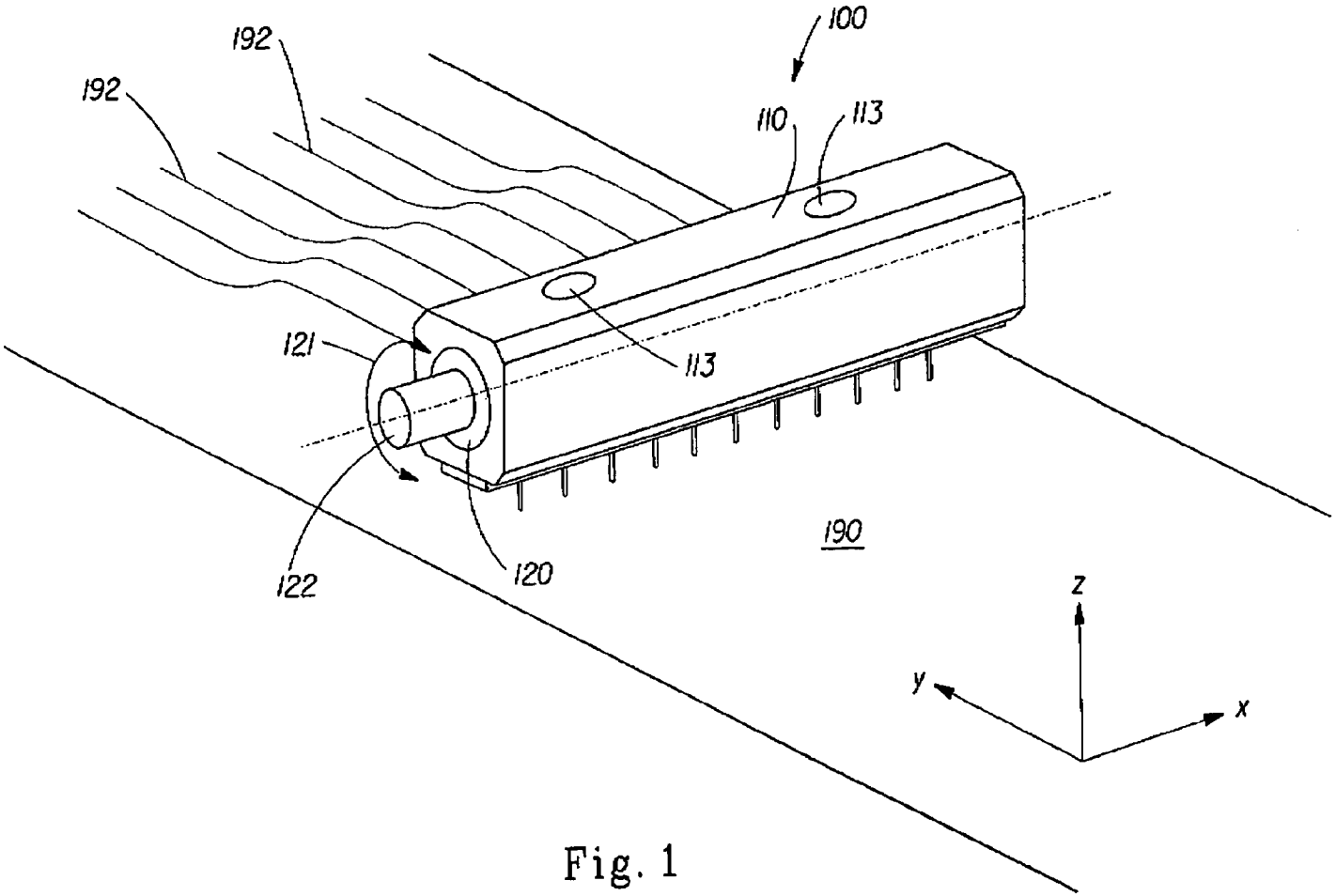
FIG. 1 is a perspective view of an exemplary, non-limiting embodiment of a hot-melt extrusion applicator in accordance with the present invention.

FIG. 1 is a perspective view of an exemplary, non-limiting embodiment of a hot-melt extrusion applicator 100 in accordance with the present invention. Applicator 100 includes a housing 110 and valve 120. While housing 110 is shown as an oblong, cubic support structure, said housing may be configured in a variety of shapes. Generally, housing 110 is provided with a selected width that will enable a desired width for product application. Housing 110 may also include at least one housing inlet 113 for the introduction and further processing of hot-melt 192. Valve 120 provides shuttering functionality and profiled application functionalities. To provide such functionalities, valve 120 may be rotated as indicated by arrow 121. Said rotation may be accomplished by providing a journal 122 having first and second ends, wherein said first end is connected to valve 120 and said second end is connected to an actuator (not shown) which provides said rotational motion. When valve 120 is in an open position, hot-melt 192 flows directly out of said valve and onto a material 190 (e.g., moving web, transfer drum, belt or any other like devices).

Figure 2:
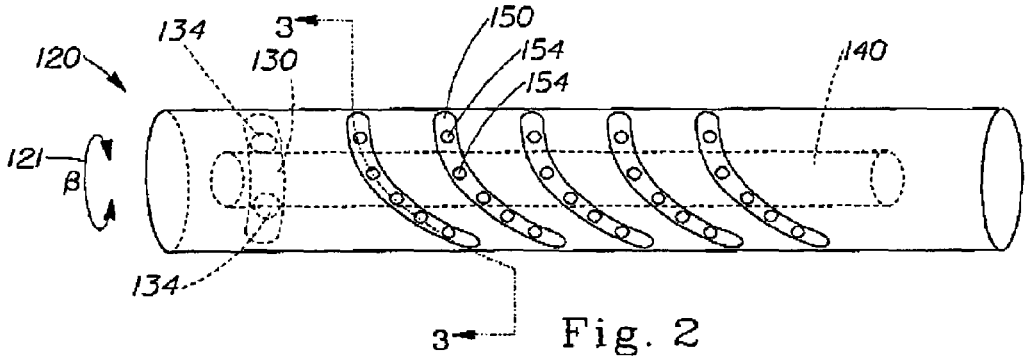
FIG. 2 is a perspective view of the valve from the applicator of FIG. 1.
Figure 3:
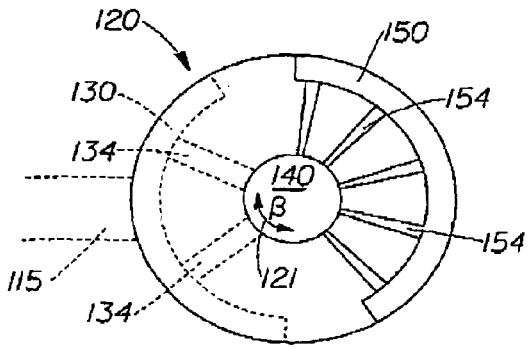
FIG. 3 is a cross-sectional view of the valve from FIG. 2 taken along line 3—3.

Referring now to FIGS. 2 and 3, a valve 120 from applicator 100 of FIG. 1 is shown. More specifically, FIG. 2 depicts a perspective view of valve 120 and FIG. 3 depicts a cross-sectional view of valve 120 taken along line 3—3 from FIG. 2. Valve 120 includes an inlet groove 130 which receives hot-melt 192 from housing channel 115 (see FIG. 3). Housing channel 115 receives said hot-melt from housing inlet 113 (see FIG. 1). In these figures, valve 120 is shown in an open position such that the flow of hot-melt 192 is free to pass through said valve. This open position is accomplished by rotating journal 122 (see FIG. 1), which is connected to valve 120, in the direction of arrow 121 such that inlet groove 130 is in fluid communication with housing channel 115. Valve 130 further includes inlet bores 134 which feed hot-melt 192 from inlet grooves 130 to valve reservoir 140. Valve reservoir 140 serves as a manifold for outlet bores 154 by maintaining a substantially constant supply and pressure. After hot-melt 192 is delivered to outlet bores 154, said hot-melt travels into outlet groove 150. Since each of these components (i.e., inlet grove 130, inlet bores 134, valve reservoir 140, outlet bores 154 and outlet grooves 150) are an integral part of valve 130, they each rotate with said valve as indicated by arrow 121. Such unitary rotation will be discussed later.

Figure 4:
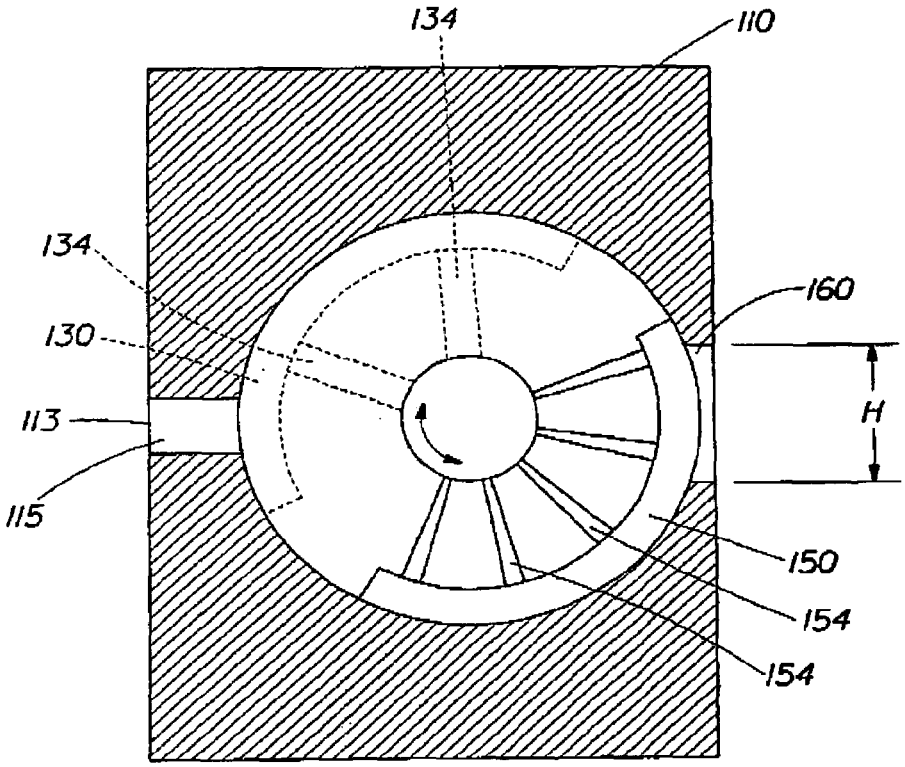
FIG. 4 is a cross-sectional view of the valve from FIG. 2 along with the surrounding housing.

FIG. 4 is a cross-sectional view of the valve from FIG. 2 along with the surrounding housing 110. In this view, the fluid communication between housing inlet 113, housing channel 115 and inlet groove 130 are more clearly depicted. Additionally, slot 160 is shown within housing 110. Slot 160 is an opening within housing 110 that is in fluid communication with outlet groove 150. Slot 160 has a height, width, and depth dimension. The height, H, of slot 60 is a critical factor for the shaping of hot-melt 192 being extruded from outlet grooves 150. Preferably, the width of slot 60 should be at least as wide as the outer most outlet grooves 150. The depth of slot 60 is the least critical dimension and therefore may be set at a variety of depths.

Figures 5A, 5B:
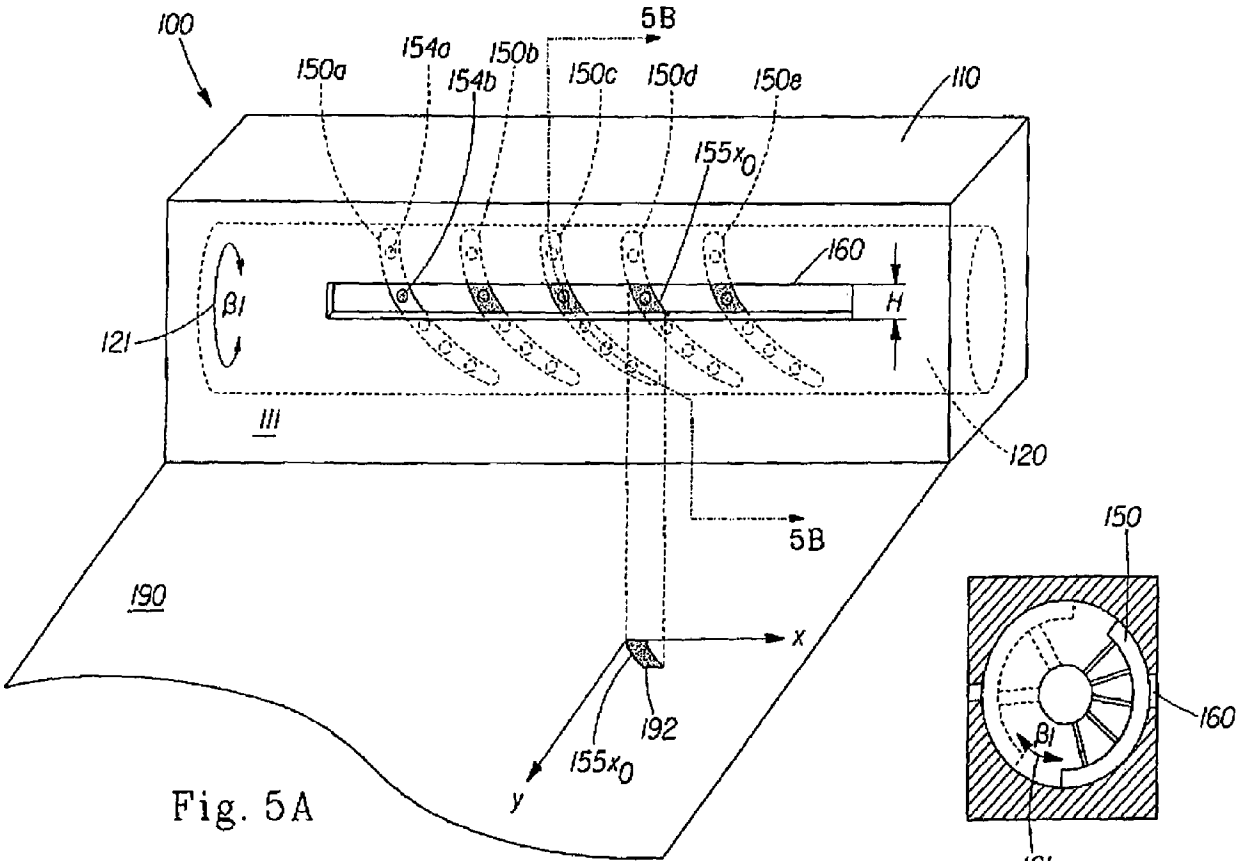
FIG. 5*a* is a perspective view of the applicator from FIG. 1, wherein the applicator is rotated with its extrusion-side surface facing the viewer for illustrative purposes, wherein a first application of hot-melt is applied to a web of material.
FIG. 5*b* is a cross-sectional view of the valve and housing from FIG. 5*a* taken along line 5*b*—5*b;*
Figures 6A, 6B:
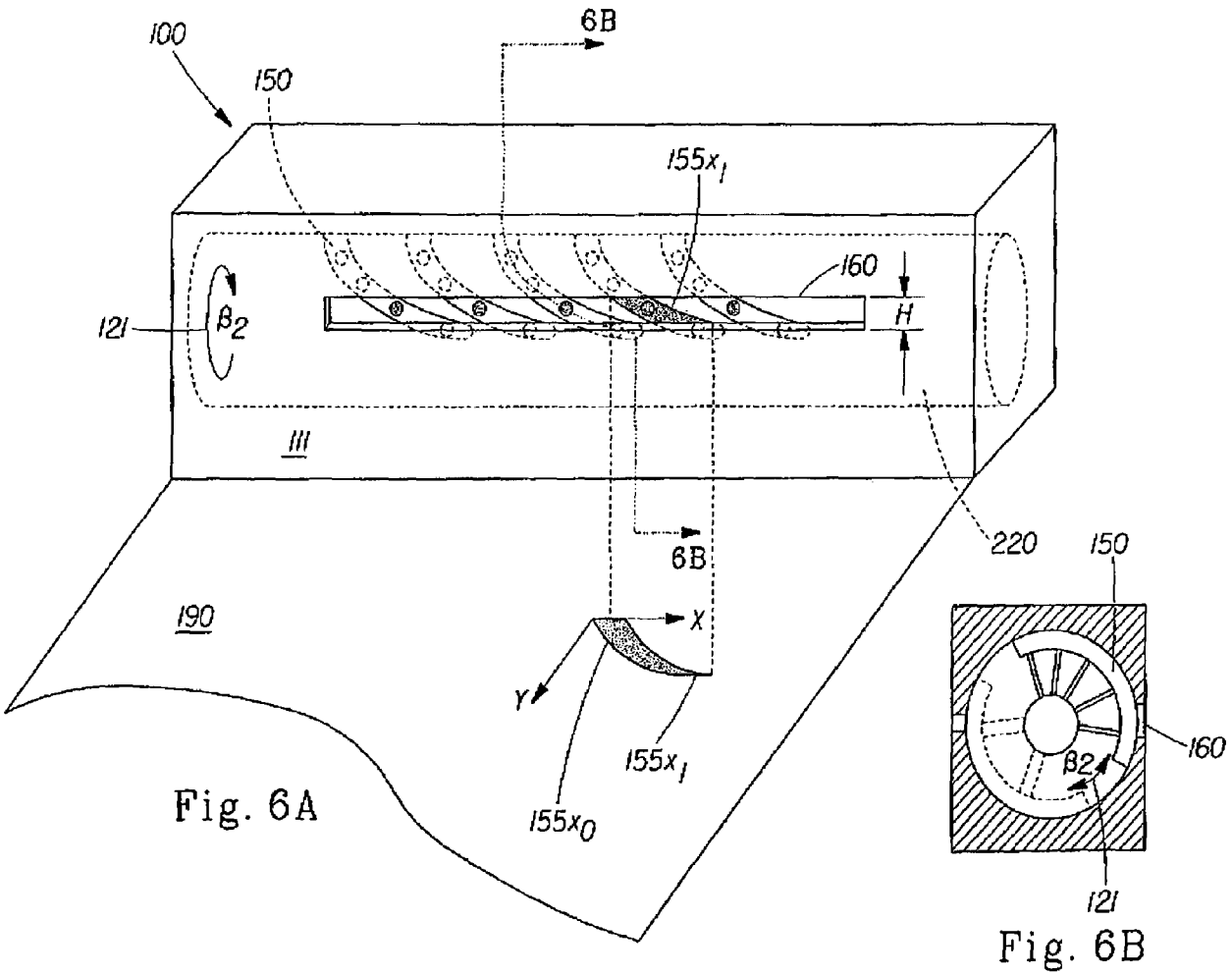
FIG. 6*a* is a perspective view of the applicator from FIG. 5*a*, wherein the applicator is rotated with its extrusion-side surface facing the viewer for illustrative purposes, wherein a second application of hot-melt is applied to a web of material.
FIG. 6*b* is a cross-sectional view of the valve and housing from FIG. 6*a* taken along line 6*b*—6*b;*

FIG. 5*a* is a perspective view of the applicator from FIG. 1, wherein applicator 100 is rotated with its extrusion-side surface 111 facing the viewer for illustrative purposes and wherein a first application of hot-melt 192 (shown herein as callout 155$x_0$) is applied to a web of material 190 (x-y axis shown for illustrative purposes). FIG. 5*b* is a cross-sectional view of said valve and housing from FIG. 5*a* taken along line 5*b*—5*b*. While this particular embodiment shows valve 120 having five outlet grooves 150, any number of outlet grooves may be used in practicing the present invention. Now with particular focus on outlet grooves 150, outlet grooves 150 are supplied with hot-melt 192 by outlet bores 154. While a first outlet groove 150*a* is shown with a first outlet bore 154*a* being positioned behind extrusion-side surface 111 and a second outlet bore 154*b* visible through slot 160, all of the outlet bores are supplying the outlet groove 150 with hot-melt 192 during the full rotation of said valve 130. Furthermore, while only within the circumference of outlet bore 154*b* for outlet groove 150*a* is hot-melt shown, the more realistic extrusion pattern of the hot-melt from outlet groove 150 and through slot 160 is shown with outlet grooves 150*b*, 150*c*, 150*d*, and 150*e*. As such, the extrusion pattern is shown to be dimensionalized by the height, H, of slot 160 and the width, depth and orientation of outlet grooves 150 (which is a function of the rotational position, $\beta_1$, of valve 130 as indicated by arrow 121). For example, a first product extrusion 155$x_0$ is shown being deposited from outlet groove 150*d*. For illustrative purposes, first product extrusion 155$x_0$ has an initial position along both the x and y axes. Now referring to like FIGS. 6*a* and 6*b*, a second product extrusion 155$x_1$ is shown also being deposited from outlet groove 150*d* and having a different rotational position, $\beta_2$. Consequently, second product extrusion 155$x_1$ has a position along the x and/or y axes that is different from that the initial position of first product extrusion 155$x_0$. In some embodiment, it may be desirable that the dimensions of first product extrusion 155$x_0$ and second product extrusion 155$x_1$ are different, as exampled in FIG. 6*a*. In some embodiments, first product extrusion 155$x_0$ and second product extrusion 155$x_1$ may be deposited so as to create a continuous deposition (i.e., strand) of hot-melt. In some embodiments, said strands may be non-linear (e.g., curved elastic).

Figure 7:
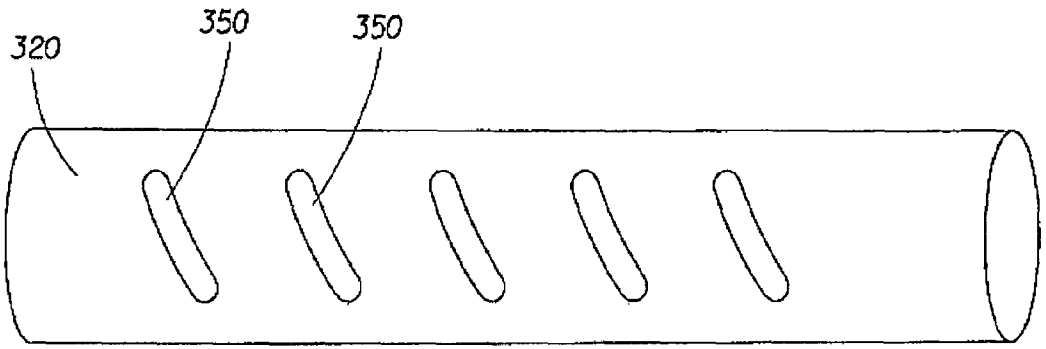
FIG. 7 is a perspective view of another exemplary, non-limiting embodiment of a valve in accordance with the present invention.
Figure 8:
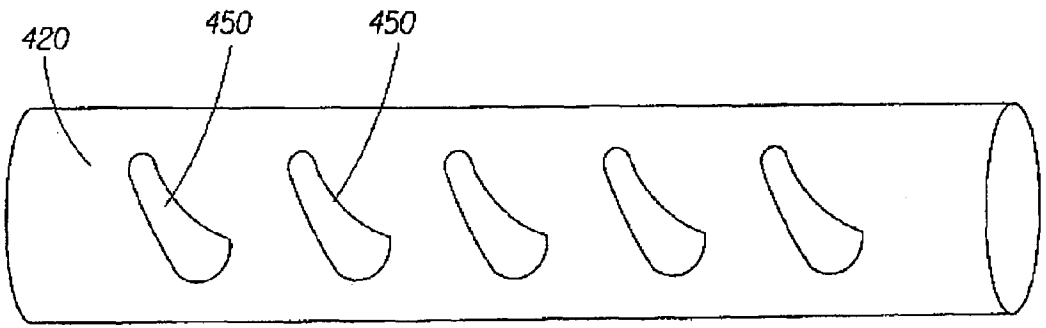
FIG. 8 is a perspective view of yet another exemplary, non-limiting embodiment of a valve in accordance with the present invention.
Figure 9:
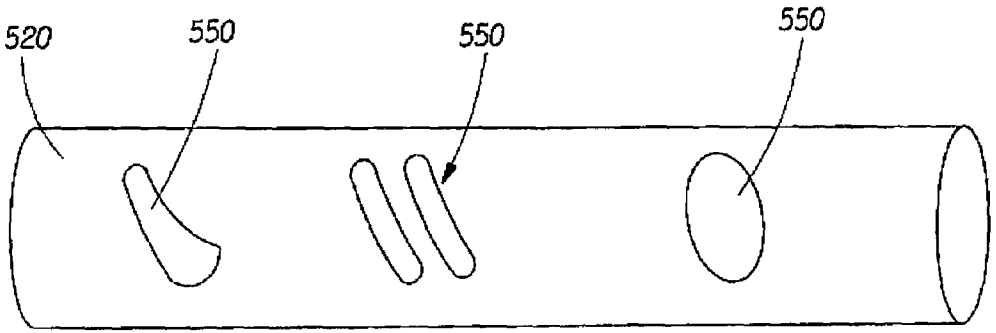
FIG. 9 is a perspective view of yet another exemplary, non-limiting embodiment of a valve in accordance with the present invention.
Figure 10:
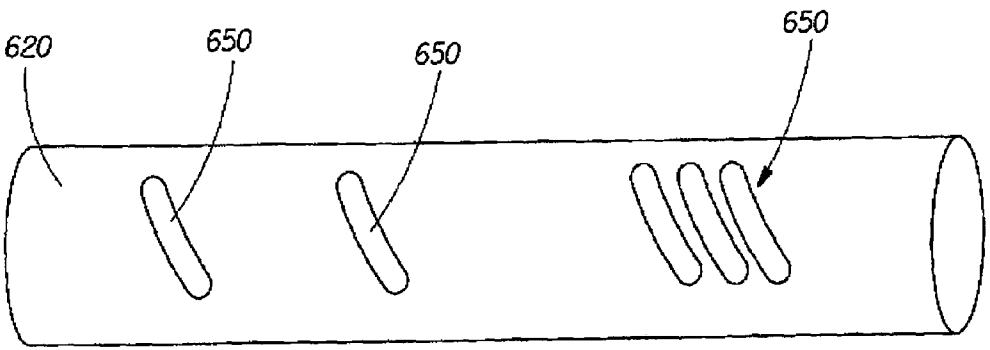
FIG. 10 is a perspective view of yet another exemplary, non-limiting embodiment of a valve in accordance with the present invention.

FIG. 7 is a perspective view of another exemplary, non-limiting embodiment of a valve 320 having outlet grooves 350 which are designed to deliver multiple strands having substantially the same individual dimensions and substantially the same distance between each strand despite changes in rotational position. FIG. 8 is a perspective view of another exemplary, non-limiting embodiment of a valve 420 having outlet grooves 450 which are designed to deliver multiple strands having substantially the same individual dimensions but varying distances between each strand during changes in rotational position. FIG. 9 is a perspective view of another exemplary, non-limiting embodiment of a valve 520 having outlet grooves 550 which are designed to deliver multiple strands having varying individual dimensions and varying distances between each strand during changes in rotational position. FIG. 10 is a perspective view of another exemplary, non-limiting embodiment of a valve 620 having outlet grooves 650 which are designed to deliver multiple strands having substantially the same individual dimensions but varying distances between each strand and different number of strands per group during changes in rotational position.

Figure 11A:
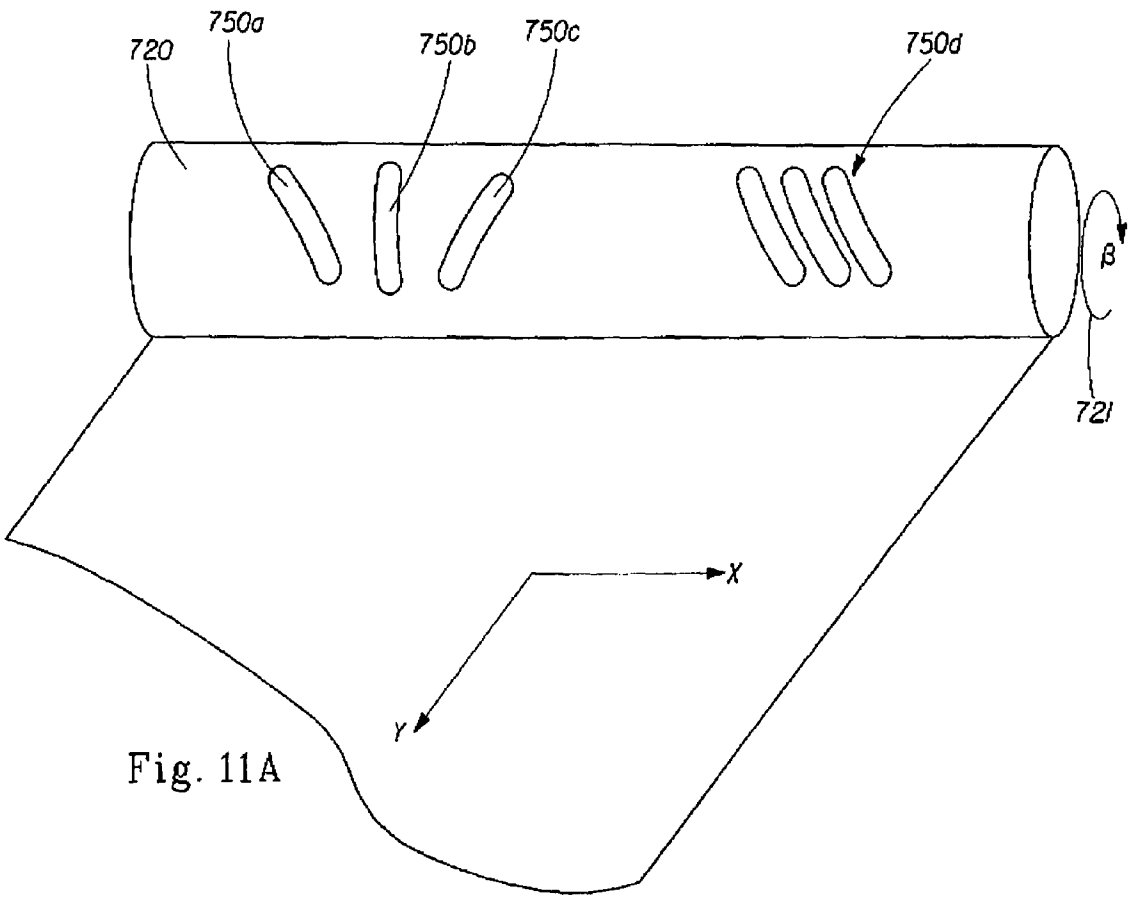
FIG. 11*a* is a perspective view of yet another exemplary, non-limiting embodiment of a valve in accordance with the present invention, wherein the valve has a variety of outlet grooves.
Figure 11B:
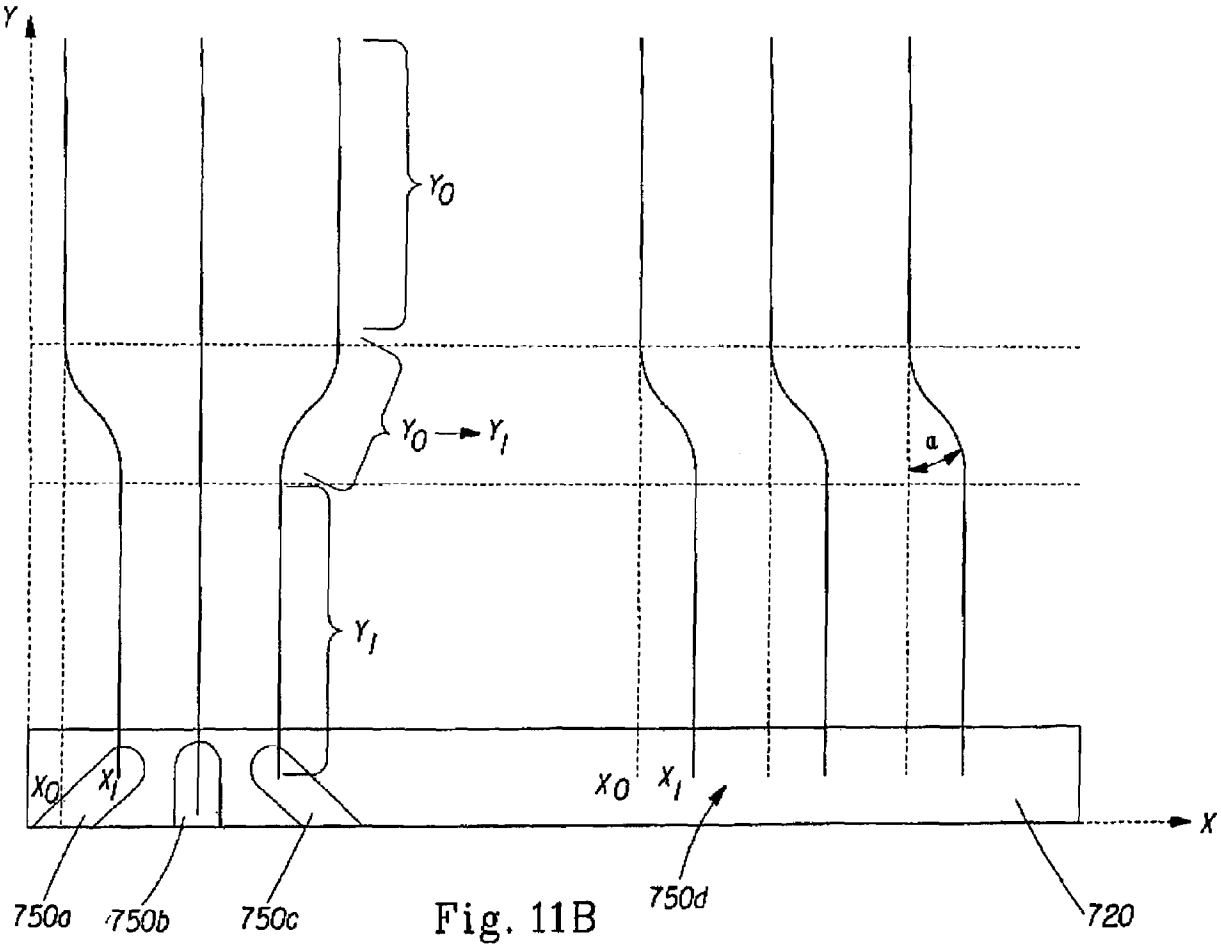
FIG. 11*b* is a schematic view of the product deposition resulting from the use and rotation of the valve from FIG. 11*a*.

FIG. 11*a* is a perspective view of yet another exemplary, non-limiting embodiment of a valve 720 having outlet grooves 750*a*, 750*b*, 750*c*, and a set of outlet grooves 750*d*. In this embodiment, 750*a*, 750*b*, and 750*c* are substantially similar in overall shape, however, they have different orientations such that they are not parallel to each other. For illustrative purposes, a set of outlet grooves 750*d* is also provided such that said grooves are substantially parallel to each other; however, they are not longitudinally parallel to valve 720. With reference being made to the x and y axis in FIG. 11*a*, FIG. 11*b* shows the resulting hot-melt deposition as valve 720 rotates as indicated by arrow 721. In FIG. 11*b*, the hot-melt extrusion from outlet groove 750*a* began at an initial position $X_0$ with a corresponding product deposition $y_o$. Upon rotation of valve 120, the hot-melt extrusion from outlet groove 750*a* shifted to a new position $X_1$ with a corresponding product deposition $y_1$ In this way, a curved strand is created. Similarly and symmetrically, outlet groove 750*c* also creates a curved strand. In contrast, outlet groove 750*b* creates a linear strand between said curved strands. Also in FIG. 11*b*, the hot-melt extrusion from the set of outlet groove 750*d* is shown to also create curved strands, however, the spacing between these strands remain substantially constant.

Figure 12:
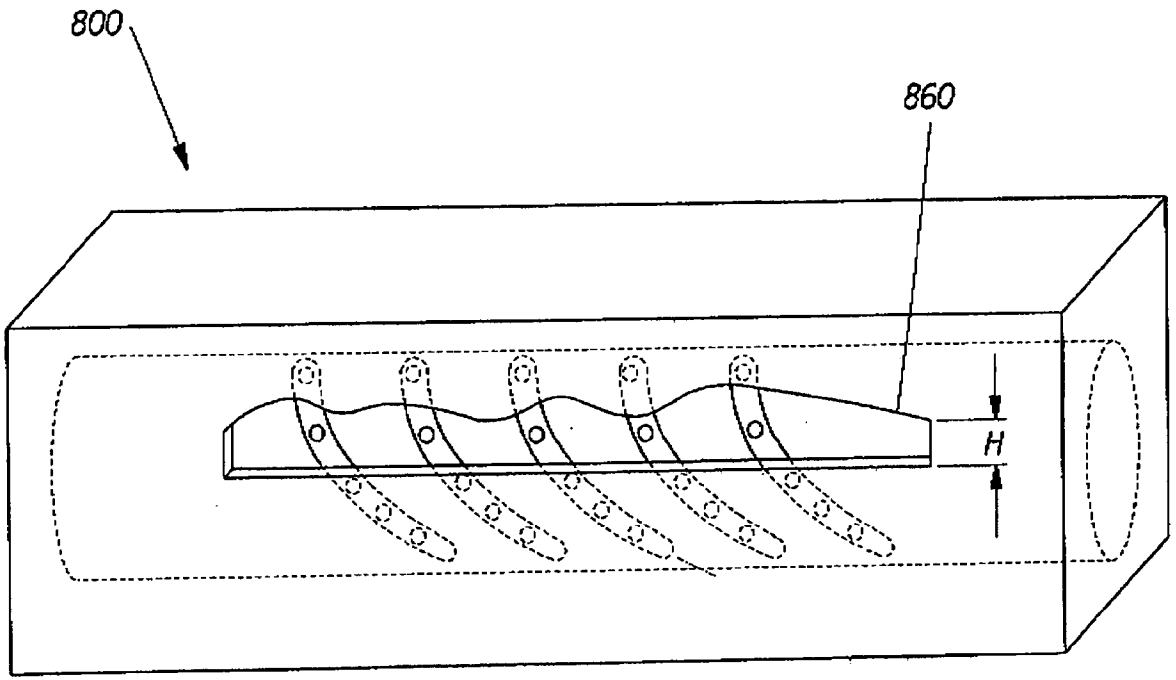
FIG. 12 is a perspective view of another exemplary, non-limiting embodiment of a hot-melt extrusion applicator in accordance with the present invention, wherein the slot has a variable height.

FIG. 12 is a perspective view of yet another exemplary, non-limiting embodiment of an applicator 800 having a slot 860 with a varying height, H. This embodiment would result in product depositions of hot-melt that have varying basis weight (e.g., varying diameter). Such a hot-melt deposition would result in some regions being stronger and some regions being weaker.

Figure 13:
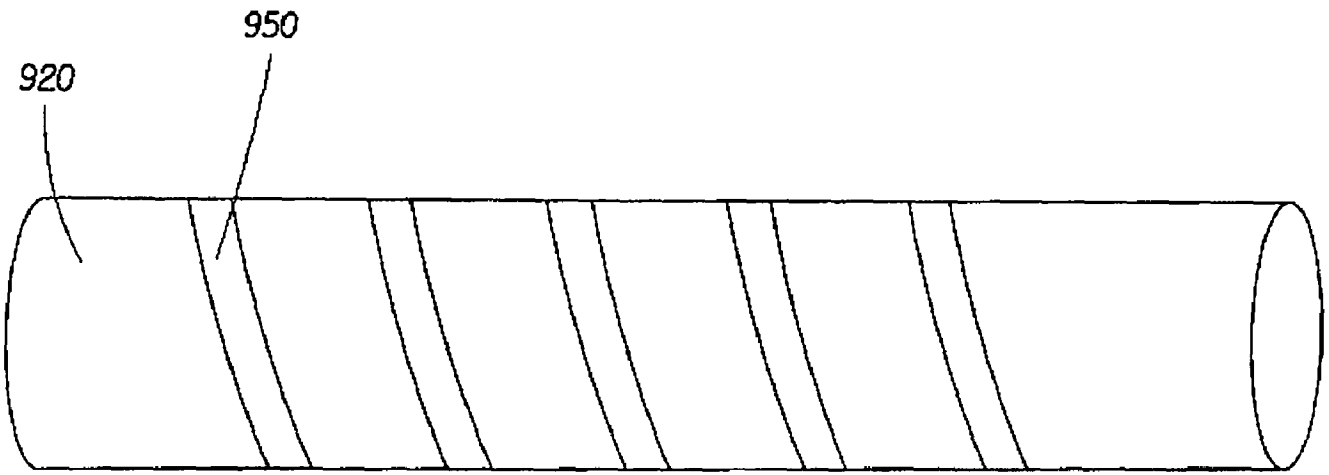
FIG. 13 is a perspective view of a valve constructed in accordance with an alternative embodiment of the invention.

While the above-illustrated embodiments show valve 120 rotating in an oscillating manner, one skilled in the art would recognize that the present invention may be appreciated with a valve 920 which continuously rotates in the same direction in order to change its product application profile (see FIG. 13). In this way, outlet grooves 950 may extend the full circumference of valve 900. Furthermore, said valve may be translated linearly to provide shuttering functionality.

All documents cited are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An applicator for application of a substance onto a material traveling along a material feed direction comprising:

a housing, said housing comprising:

at least one housing inlet for the introduction of the substance into said housing;

at least one housing channel for the distribution of the substance from said housing inlet, said housing channel being in fluid communication with said housing inlet; and at least one slot defining an elongated width extending along a direction that intersects the material feed direction, said slot being located on an extrusion-side surface of said housing, a rotatable valve, said valve comprising:

at least one inlet groove for the further distribution of the substance, said inlet groove being in fluid communication with said housing channel;

at least one inlet bore for the further distribution of the substance, said inlet bore being in fluid communication with said inlet groove;

at least one valve reservoir to provide manifold functionality of the substance, said valve reservoir being in fluid communication with said inlet groove;

at least one outlet bore for the further distribution of the substance, said outlet bore being in fluid communication with said valve reservoir; and at least one outlet groove in fluid communication with said outlet bore, wherein said outlet groove overlies and extends beyond said slot such that, as said valve is rotated, select portion of the outlet groove are placed in fluid communication with said slot along the width of said slot to form a continuous nonlinear extrusion pattern of the substance onto the material.

2. The applicator of claim 1 further comprising a journal, said journal being connected to said valve, said journal and said valve rotate together to provide profiled product application functionality.

3. The applicator of claim 1 wherein the material upon which the substance is applied is in the form of a continuous web.

4. The applicator of claim 1 wherein the material upon which the substance is applied is in the form of a belt.

5. The applicator of claim 1 wherein the material upon which the substance is applied is in the form of a drum.

6. The applicator of claim 1 wherein said valve may further rotate to provide shuttering functionality, wherein said inlet groove is not in fluid communication with said housing channel when said valve is in a closed position, wherein said inlet groove is in fluid communication with said housing channel when said valve is in an open position.

7. The applicator of claim 1 wherein said substance comprises a continuous strand of hot-melt.

8. The applicator of claim 7 wherein said strand of hot-melt is non-linear.

9. The applicator of claim 1 wherein the outlet grooves deliver multiple strands having substantially the same individual dimensions and substantially the same distance between each strand despite changes in rotational position.

10. The applicator of claim 1 wherein the outlet grooves deliver multiple strands having substantially the same individual dimensions but varying distances between each strand during changes in rotational position.

11. The applicator of claim 1 wherein the outlet grooves deliver multiple strands having varying individual dimensions and varying distances between each strand during changes in rotational position.

12. The applicator of claim 1 wherein the outlet grooves deliver multiple strands having substantially the same individual dimensions but varying distances between each strand and different number of strands per group during changes in rotational position.

13. The applicator of claim 1 wherein the outlet grooves are substantially similar in overall shape, however, they have different orientations such that they are not parallel to each other.

14. The applicator of claim 1 wherein the outlet grooves are substantially parallel to each other, however, they are not longitudinally parallel to said valve.

15. The applicator of claim 1 wherein said slot has a varying height such that the applied substance has a varying basis weight.

16. The applicator of claim 1 wherein said valve continuously rotates in the same direction in order to change its product application profile.

17. The applicator of claim 1 wherein said outlet grooves extend the full circumference of said valve.

18. The applicator of claim 1 wherein said valve may be translated linearly to provide shuttering functionality.

19. An applicator for application of a substance onto a material comprising:

a housing, said housing comprising:

at least one housing inlet for the introduction of the substance into said housing;

at least one slot defining an elongated width extending along a direction that intersects the material feed direction, said slot being located on an extrusion-side surface of said housing, a rotatable valve, said valve comprising:

at least one inlet groove fur the further distribution of the substance, said inlet groove being in fluid communication with said housing channel;

at least one inlet bore for the further distribution of the substance, said inlet bore being in fluid communication with said inlet groove;

at least one valve reservoir to provide manifold functionality of the substance, said valve reservoir being in fluid communication with said inlet groove;

at least one outlet bore for the further distribution of the substance, said outlet bore being in fluid communication with said valve reservoir; and at least one outlet groove for the extrusion of the substance onto the material, said outlet groove being in fluid communication with said outlet bore, said slot and said outlet groove together Latin an extrusion pattern of the hot-melt, wherein said housing includes at least two housing channels for the distribution of the substance from said housing inlet, said housing channels being in fluid communication with said housing inlet, said housing channels being symmetrically opposed such that a supply force of said substance exerted on said valve is reduced.

20. An applicator for application of a substance onto a material traveling along a feed direction, the applicator comprising:

a housing including 1) a housing channel carrying the substance, and 2) at least one slot defining an elongated width extending along a direction that intersects the material feed direction, the slot being located on a housing surface; and a rotatable valve, said valve comprising:

at least one outlet bore in fluid communication with said channel; and at least one outlet groove receiving said substance from said outlet bore, wherein said outlet groove overlies said slot to provide an exit opening for the substance, wherein said exit opening translates along a width of said slot as said valve is rotated to provide a continuous nonlinear extrusion pattern of the substance onto the material.

* * * * *

UNITED STATES PATENT AND TRADEMARK OFFICE

CERTIFICATE OF CORRECTION

PATENT NO. : 7,097,710 B2
APPLICATION NO. : 10/834503
DATED : August 29, 2006
INVENTOR(S) : Schneider It is certified that error appears in the above-identified patent and that said Letters Patent is hereby corrected as shown below:

Column 7
Line 21, delete “portion” and insert --portions--.

Column 8
Line 24, delete “fur” and insert --for--.
Line 39, delete “Latin” and insert --form--.

Signed and Sealed this

Second Day of September, 2008

JON W. DUDAS
*Director of the United States Patent and Trademark Office*